US006305022B1

(12) United States Patent
Oomura et al.

(10) Patent No.: US 6,305,022 B1
(45) Date of Patent: Oct. 23, 2001

(54) GLOVE FOR BASEBALL OR SOFTBALL

(75) Inventors: Noboru Oomura; Ken Motooka, both of Hyogo (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 09/508,231

(22) PCT Filed: Aug. 6, 1999

(86) PCT No.: PCT/JP99/04295

§ 371 Date: Mar. 9, 2000

§ 102(e) Date: Mar. 9, 2000

(87) PCT Pub. No.: WO00/10658

PCT Pub. Date: Mar. 2, 2000

(30) Foreign Application Priority Data

Aug. 24, 1998 (JP) ..... 10-254639

(51) Int. Cl.[7] ..... A41D 13/08
(52) U.S. Cl. ..... 2/19
(58) Field of Search ..... 2/19, 158, 159, 2/161.1, 161.6, 161.7, 168, 169

(56) References Cited

U.S. PATENT DOCUMENTS

Re. 14,025 * 12/1915 Baskin ..... 2/159
906,278 * 12/1908 Peterson ..... 2/19
962,438 * 6/1910 King ..... 2/19
1,037,946 * 9/1912 Mahieu ..... 2/159
1,219,248 * 3/1917 Carson ..... 2/159
1,588,426 * 6/1926 Kabat ..... 2/19
1,589,516 * 6/1926 Denkert ..... 2/19
4,227,263 * 10/1980 Zidele ..... 2/19
4,515,852 * 5/1985 Katabe et al. ..... 428/246
4,928,320 * 5/1990 Aoki ..... 2/19
5,398,342 * 3/1995 Kinnee et al. ..... 2/19
5,442,816 * 8/1995 Seketa ..... 2/161.7

FOREIGN PATENT DOCUMENTS 10-165558 6/1998 (JP) .
WO00/10658 3/2000 (WO) .

* cited by examiner

*Primary Examiner*—John J. Calvert
*Assistant Examiner*—Gary L. Welch
(74) *Attorney, Agent, or Firm*—McDermott, Will & Emery

(57) ABSTRACT

A glove for baseball or softball according to the present invention includes back leather (1) having five finger portions (29), ball receiving leather (2) having five finger portions (29) to be sewed together or/and adhesively joined with back leather (1), and upper surface leather (3) sewed to back leather (1) to form a hand inserting portion. The length (L2) of ball receiving leather (2) in the direction in which the finger portion of ball receiving leather (2) extends is in the range from 95% to 100% of the length (L1) of back leather (1) in the direction in which the finger portion of back leather (1) extends.

11 Claims, 7 Drawing Sheets

GLOVE FOR BASEBALL OR SOFTBALL

TECHNICAL FIELD

The present invention relates to a glove for baseball or softball having a novel configuration.

BACKGROUND ART

A conventional glove for baseball or softball (hereinafter simply as "glove") is formed as follows. First, ball receiving leather 16 having five approximately finger-shaped portions as shown in FIG. 7C, and back leather 15 having a plurality of leather parts sewed together to form five finger stalls as shown in FIG. 7A are prepared. Their peripheries are sewed except for the part to insert a hand such that both grain sides form the inside. Then, it is turned inside out so that the grain sides come outside and the front member is thus formed.

Then, the periphery of palm leather 18 as shown in FIG. 7D having a smaller size than the front member and five approximately finger-shaped portions and rear leather 17 as shown in FIG. 7B having a plurality of leather parts sewed to form five finger stalls are sewed together except for the part to insert a hand such that also both grain sides form the inside. This forms the back member.

At various necessary points of the front member, a padding of felt and other shock absorbers are inserted, wax is applied, or the member is impregnated with oil. Then, the back member is inserted into the front member, and then the hand inserting portions of the front and back members are combined with a leather lace 75 as shown in FIG. 6.

Then, a separately formed web portion (ball receiving portion) 19 is attached between the thumb stall and the index finger stall also with leather laces 75, and the baseball glove is completed.

FIG. 8 is a cross sectional view of the middle finger stall. As shown in FIG. 8, the back member formed of palm leather 18 and rear leather 17 is inserted into the front member formed of ball receiving leather 16 and back leather 15. A finger padding 20 is sewed to palm leather 18.

As described above, it requires a lot of work to manufacture the conventional glove.

In particular, the operation of turning inside out ball receiving leather 16 and back leather 15 having their peripheries sewed together excluding the hand inserting portion such that the grain sides come outside is not only cumbersome and requires force but also encounters the following problem.

More specifically, by simply turning inside out ball receiving leather 16 and back leather 15 having their peripheries sewed together, the thread is exposed, which spoils the appearance of the product. Furthermore, the tip end of the glove could contact with the ground when the user catches a grounder, so that the thread touches the ground as well and could be cut.

Therefore, a band type leather lace 76 is held and sewed between ball receiving leather 16 and back leather 15 or between other leather parts (see FIGS. 6 and 8). Thus, if ball receiving leather 16 and back leather 15 are sewed and then turned inside out, the thread would hardly come out. As a result, the appearance is improved, and since the thread does not directly touch the ground, it would not be cut.

However, ball receiving leather 16 and back leather 15 must be sewed together while holding thin, band shaped leather lace 76 therebetween, which requires a lot of work as well as skill.

Furthermore, when ball receiving leather 16 and back leather 15 are turned inside out, deformation (expansion) of leather at respective inter-finger parts 77 is maximized, and therefore significant force is imposed on these parts.

The vicinity of inter-finger parts 77 is positioned close to the center of the glove and is frequently hit with a ball. As a result, the thread at the part is liable to be cut or the leather at the part is likely to be damaged and tear by repeatedly catching a ball.

Furthermore, the glove is mainly formed of four leather parts, i.e., ball receiving leather 16, back leather 15, palm leather 18 and rear leather 17 as shown in FIGS. 7A to 7D. A padding of felt for example and a shock absorber of other material are inserted within these leather parts. Since a web part is also attached to them, the glove as a whole would be significantly heavy.

If the glove has the above structure, it is difficult to reduce the amount of leather to reduce the weight. Therefore, there is no way other than to reduce the amount of the padding of felt or the like or the shock absorber to be inserted in order to reduce the weight of the glove. When the reduction of impact is considered, however, the shock absorber cannot be reduced very much.

Furthermore, in the process of joining the hand inserting portions of the front member and the back member using leather lace 75, the lace must be passed through a number of times, which requires significant force and a very cumbersome operation.

Therefore, the inventors have made the invention as disclosed by Japanese Patent Laying-Open No. 10-165558 in order to solve the above-described disadvantage associated with the conventional glove.

This invention however still has the following problem. In the disclosure of this invention, the back leather is cut to be slightly larger than the ball receiving leather, but about how much the back leather should be larger than the ball receiving leather is not clearly stated. As a result, at the time of manufacturing such a glove as disclosed by the document, the size of each part should be set by the eye.

However, when the inventors actually fabricated such gloves as they set the sizes of the back leather and front leather by the eye, a desired arc shape was obtained on the ball receiving side of the gloves in some cases and was not in other cases.

Thus, the inventors studied for the reason into detail, and learned that slight difference in the sizes of the back leather and front leather could affect the shape of the glove on the ball receiving side. When a desired arc shape is not obtained, not only the performance of the glove but also the yield could be lowered, and therefore it is very important to find out the relation between the sizes of the back leather and the ball receiving leather in the manufacture of gloves.

In addition, the glove according to the above invention, no shock absorber is employed excluding the part from the thumb portion to the little finger portion through the vicinity of the periphery of the palm portion (the bank portion). Therefore, the impact at the time of catching a ball is directly transmitted to the fingers, and the fingers are sometimes hurt during repetition of ball catching exercise for hours.

Moreover, the shock absorber from the thumb portion via the vicinity of the periphery of the palm portion to the little finger portion is held between notches formed at the ball receiving leather. The process of providing the notches or cutting the leather to cover the shock absorber into a form corresponding to the notches involves a relatively cumbersome operation.

DISCLOSURE OF INVENTION

The present invention is directed to a solution to the above-described problems. One object of the present invention is to allow the same arc shape to be always formed on the ball receiving side of a glove by defining the size ratio of the back leather and ball receiving leather while maintaining the effects brought about by the invention disclosed by Japanese Patent Laying-Open No. 10-165558 as is. Another object of the present invention is to provide a glove with an increased shock reducing effect at the time of catching a ball without the necessity of increasing the number of operations in the manufacturing step in addition to the above content.

The glove (ball catching implement) according to the present invention includes back leather having a first finger portion, ball receiving leather having a second finger portion attached to first finger portion, and upper surface leather sewed to back leather for forming a hand inserting portion. The length (L2) of ball receiving leather in the direction in which second finger portion extends (the direction parallel to the lengthwise direction of the second finger part) is in the range from 95% to 100% of the length (L1) of back leather in the direction in which the first finger portion extends.

Since the relation between the sizes of the back leather and ball receiving leather significantly affects the performance and yield of the glove, the inventors earnestly studied about the relation of the sizes of the back leather and ball receiving leather, and successfully established a preferable ratio of the sizes. More specifically, by setting the length (L2) of ball receiving leather in the direction in which second finger portion extends to be 95% to 100% of the length (L1) of back leather in the direction in which first finger portion extends, a desired arc shape can be stably formed on the ball receiving side. Thus, a high performance glove can be stably obtained and the yield can be greatly improved. Since the glove is basically finished by sewing together or/and adhesively joining back leather having upper surface leather sewed thereto and ball receiving leather, the operation of turning inside out the back leather and the ball receiving leather after sewing is not necessary. In addition, the number of parts is reduced, the amount of leather to use can be reduced, and the glove can be lightweight and easy to manufacture.

The first and second finger parts described above include an index finger portion (index finger stall forming part). The lengths (L1 and L2) of ball receiving leather and back leather are lengths both in the direction in which index finger portion extends.

The length (L2) of ball receiving leather is preferably in the range from 96% to 98% of the length (L1) of back leather. More preferably, the length (L2) is 97% of length (L1).

By setting length (L2) in the range of percentage described above relative to (L1), a desired arc shape can be surely formed on the ball receiving side. If the above numerical values are fixed, a glove having a curvature almost fixed at the ball receiving surface can be obtained readily and with high reproducibility.

Back leather and ball receiving leather preferably have a palm portion (a portion corresponding to a ball receiving surface). The length (L11) of first finger portion is preferably the same as the length (L21) of second finger portion, and the length (L22) of palm portion of ball receiving leather in the direction in which second finger portion extends is set smaller than the length (L12) of palm portion of back leather in the direction in which first finger portion extends.

The inventors have found that by setting only the length (L22) of palm portion of ball receiving leather smaller than the length (L12) of palm portion of back leather in the direction in which first finger portion extends, a desired arc shape can be formed on the ball receiving side. In addition, each finger portion of the glove can be formed into an approximately linear shape and only the ball receiving portion of the glove can be formed to have an arc shape. Thus, a glove having an ideal shape for catching a ball can be provided.

First and second finger parts each include five finger portions. The width (W1) of back leather in the direction in which first finger portion is arranged is preferably approximately the same as the width (W2) of ball receiving leather in the direction in which second finger portion is arranged.

This can also contribute to making the shape of the glove ideal.

The surface of ball receiving leather is preferably provided with a raised portion (embossed portion). A shock absorber is filled within the recess at the back of the raised portion.

In this case, when a ball is caught, the ball first hits the raised part of embossed portion filled with shock absorber, the impact of the ball is absorbed and the impact upon the fingers is reduced. Therefore, if the glove is used for exercise for hours, the fingers will be less hurt by repetition of exercise for catching a ball. The impact of a ball itself at the time of catching the ball is reduced, so that the chance of dropping the ball is reduced as well.

Raised portion is preferably formed by embossing.

Thus, raised portion can be readily formed and shock absorber is simply filled within the recessed portion formed by embossing, which reduces the necessary work in the manufacture.

A pad member is preferably provided between shock absorber and back leather.

Shock absorber can be thus secured at ball receiving leather, so that ball receiving leather and back leather can be more readily sewed together or/and adhesively joined. If a hard material is used for pad member, the finger portions can be prevented from being bent toward the backside by the pressure given by a caught ball.

One such raised portion as described above is provided at at least one position of second finger portion and a palm periphery vicinity portion.

Thus, not only impact upon the ball receiving portion of a glove but also impact upon the finger portions of the glove can be reduced.

Shock absorber described above includes at least one kind of material selected from a group consisting of sponge, felt, an air bag, silicon bouncing putty, polyurethane elastomer, silicon gel, and polynorbornane.

BEST MODE FOR CARRYING OUT THE INVENTION

Figure 1:
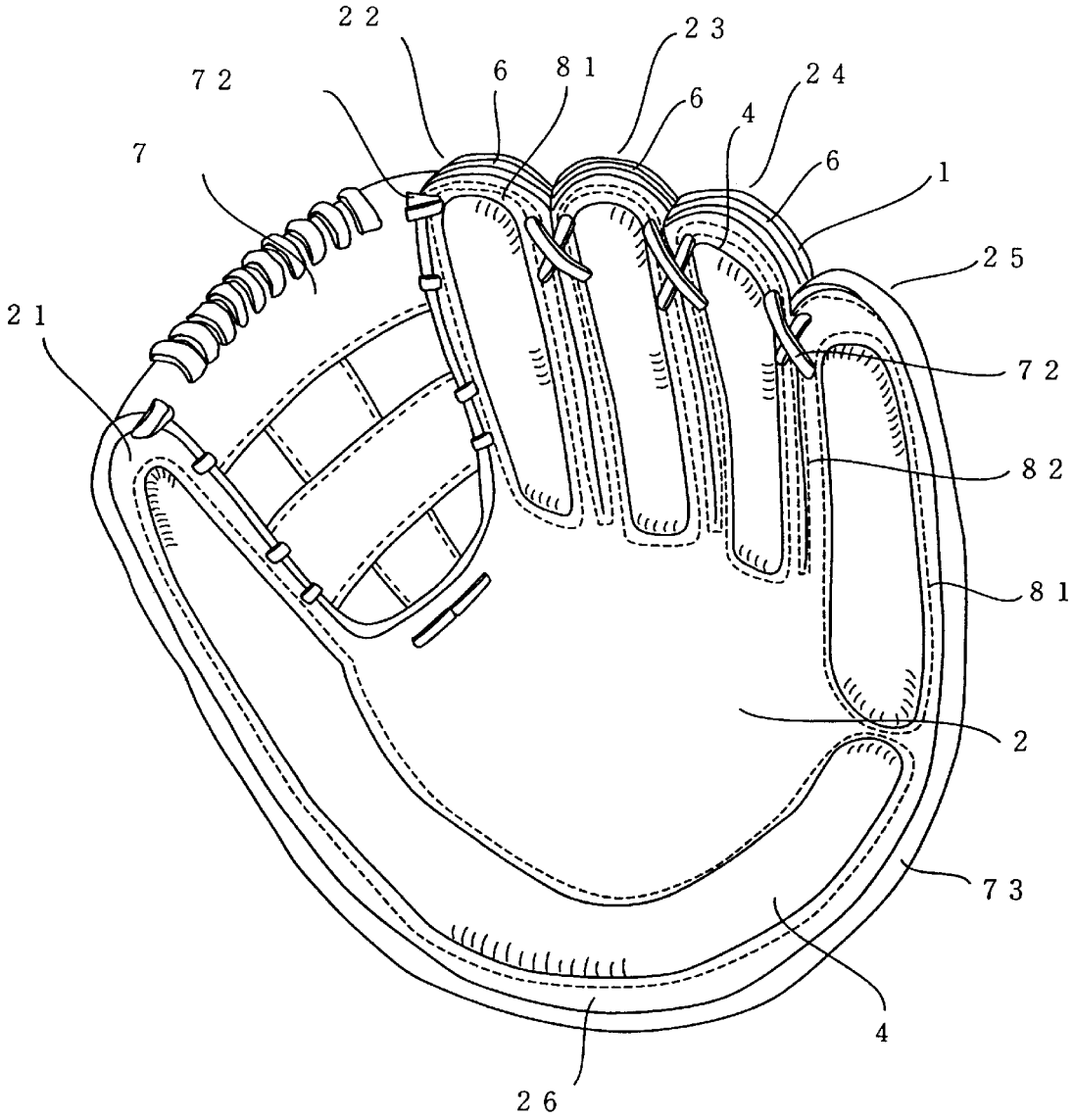
FIG. 1 is a view of a glove according to one embodiment of the present invention seen from the side of the ball receiving leather.
Figure 2:
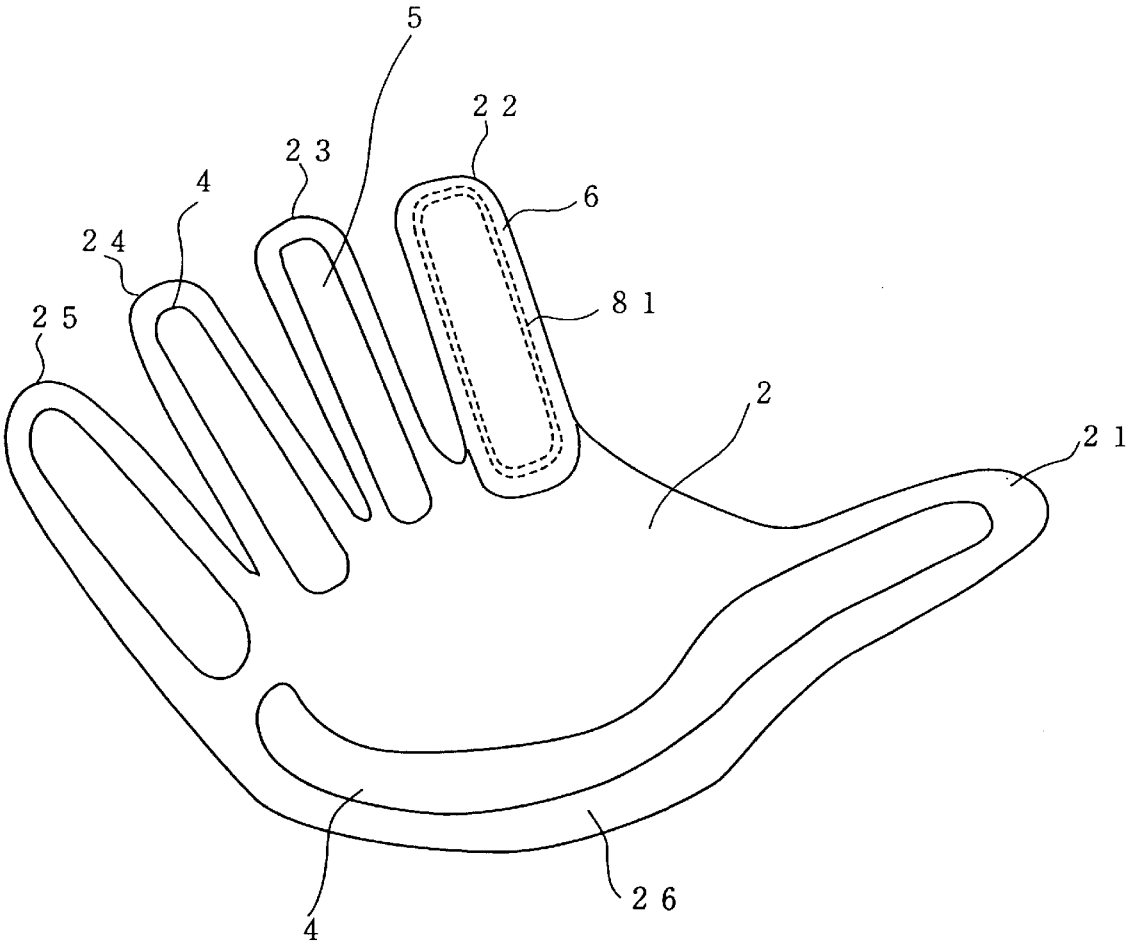
FIG. 2 is a view the ball receiving leather of the glove shown in FIG. 1 seen from the backside.
Figure 3A:
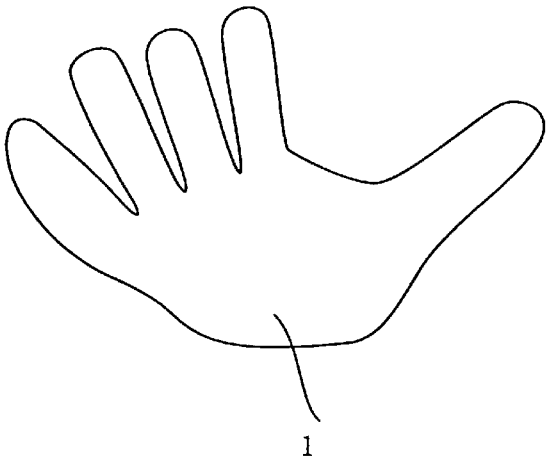
FIGS. 3A to 3C are views of parts of the glove shown in FIG. 1.
Figure 3C:
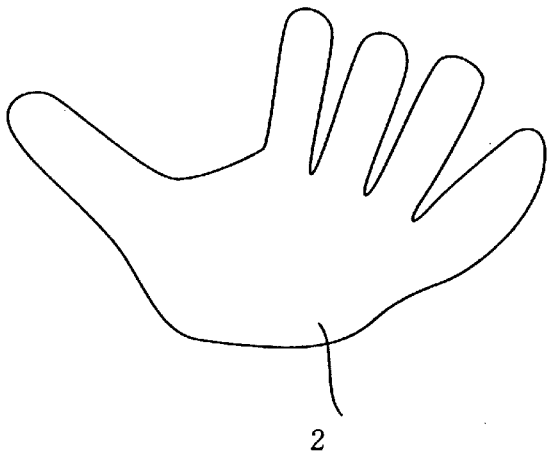
Figure 3B:
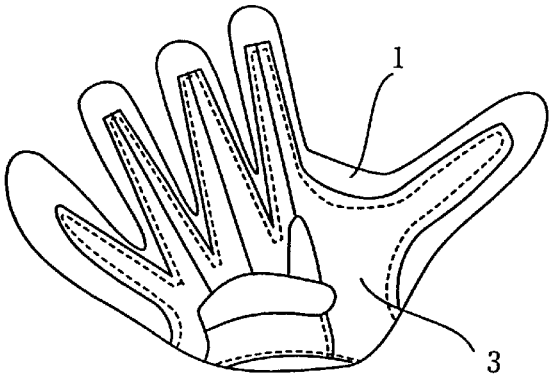
Figure 4:
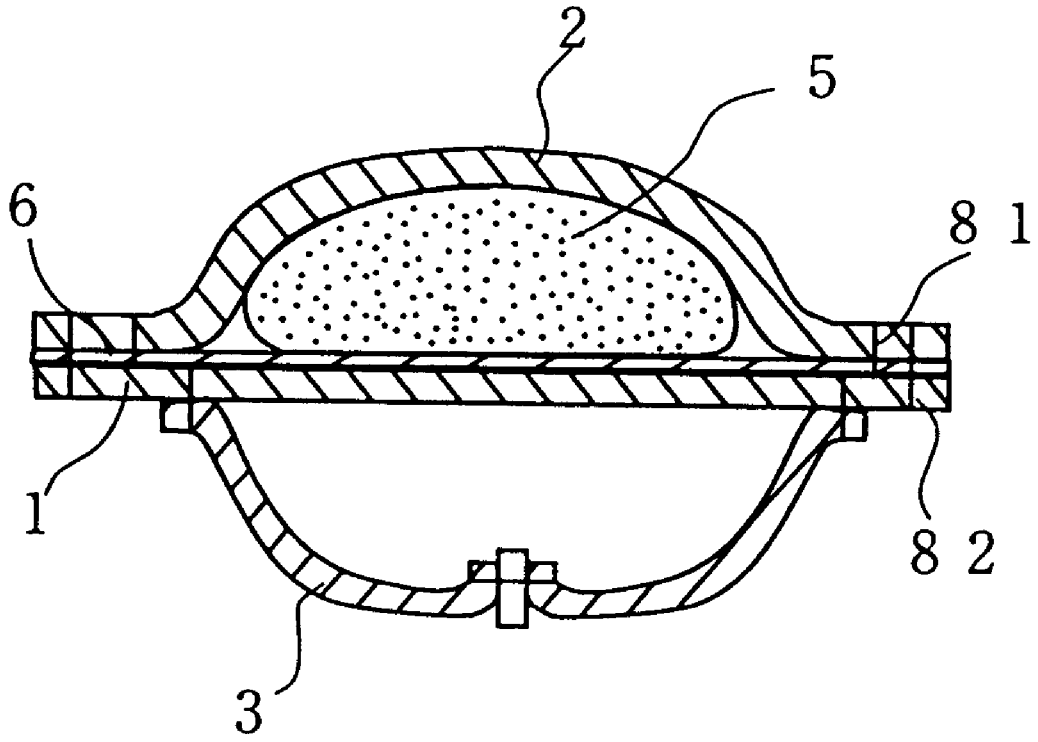
FIG. 4 is a cross sectional view of the finger portions of the glove shown in FIG. 1.
Figure 5A:
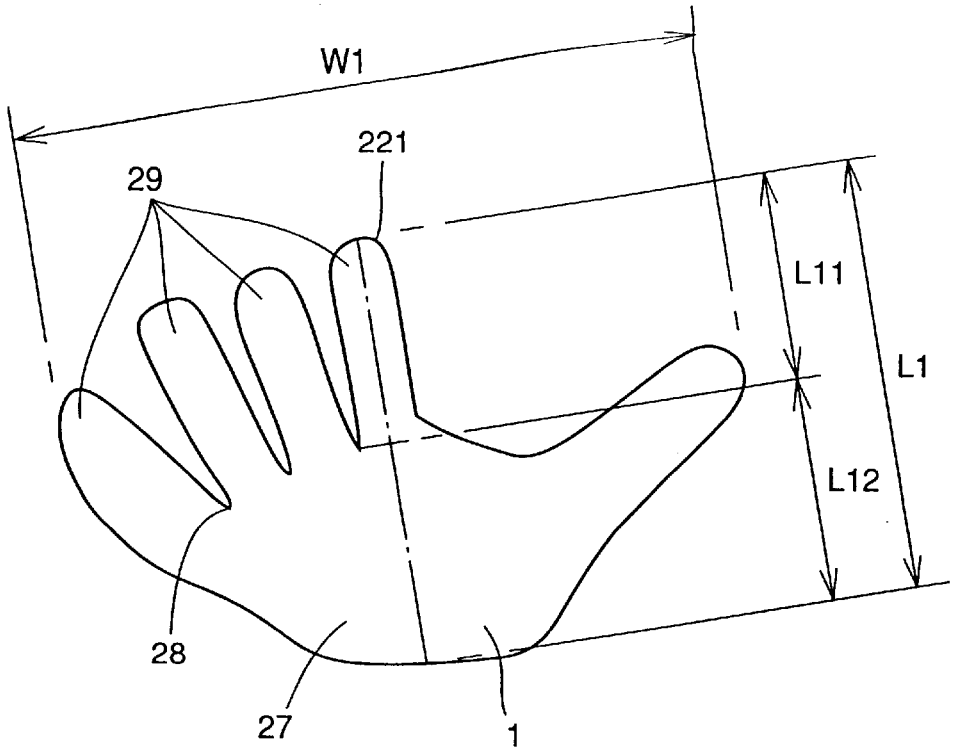
FIGS. 5A and 5B are illustrations showing the ratio of the sizes of the back leather and ball receiving leather.
Figure 5B:
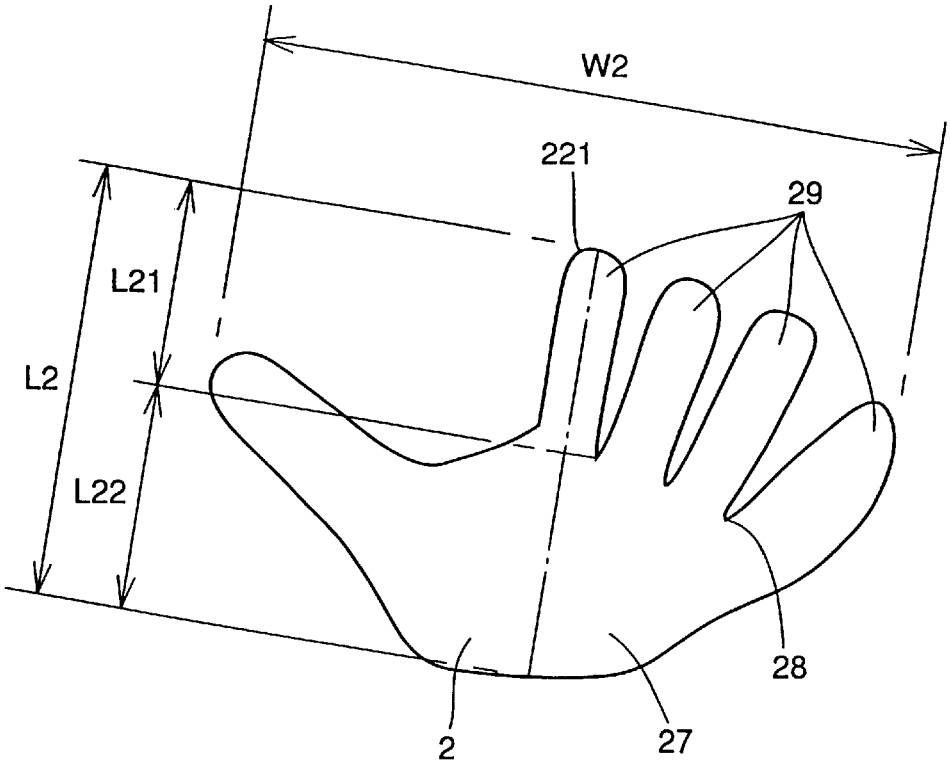
Figure 6:
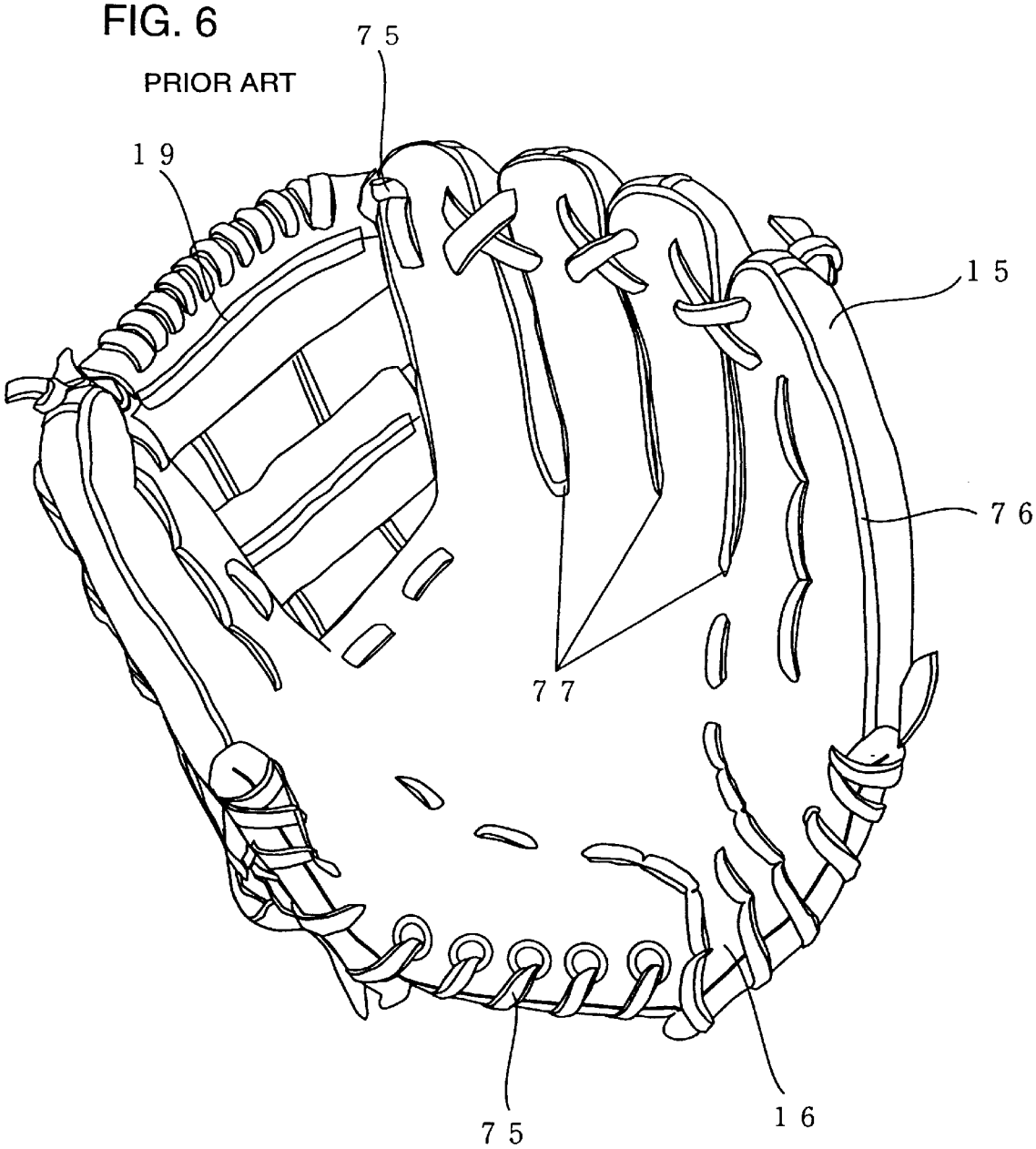
FIG. 6 PRIOR ART
FIG. 6 is a view of a conventional glove seen from the side of the ball receiving leather.
Figure 7A:
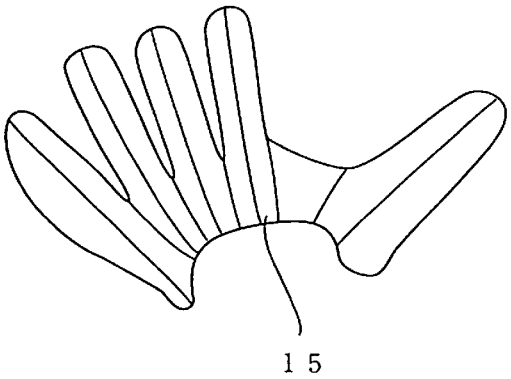
FIG. 7A PRIOR ART
FIGS. 7A to 7D are views of parts of a conventional glove.
Figure 7C:
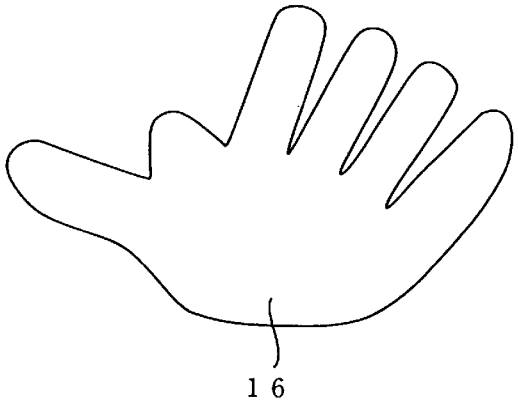
FIG. 7C PRIOR ART
Figure 7B:
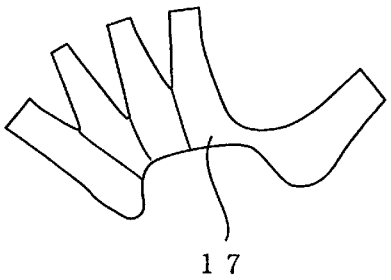
FIG. 7B PRIOR ART
Figure 7:
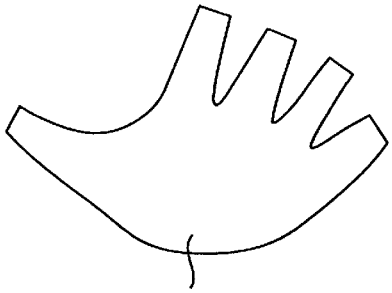
FIG. 7 D PRIOR ART
Figure 8:
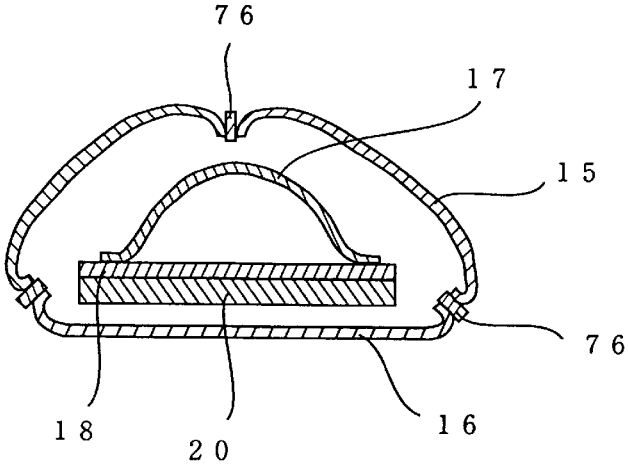
FIG. 8 PRIOR ART
FIG. 8 is a cross sectional view of a middle finger portion of a conventional glove.

FIG. 1 is a view of a glove according to the present invention seen from the side of the ball receiving leather, FIG. 2 is a view of the ball receiving leather forming the glove seen from the backside, FIGS. 3A to 3C are views showing parts forming the glove, FIG. 4 is a cross sectional view of the finger portions of a finished glove, and FIGS. 5A and 5B are illustrations showing the ratio of the sizes of the back leather and ball receiving leather.

As shown in FIGS. 3A and 3C, back leather 1 and ball receiving leather 2 are cut so that five approximately finger-shaped portions (finger portions) are formed.

Back leather 1 and ball receiving leather 2 are symmetrically cut so that the grain side comes to the front when they are sewed together (FIGS. 3A and 3C are views both seen from the grain side).

As shown in FIGS. 5A and 5B, ball receiving leather 2 is cut to be smaller than back leather 1 only by 5% or less in the direction (in the direction in which the index finger portion extends) parallel to the lengthwise direction of an index finger stall forming portion (index finger portion) 221.

More specifically, the length L2 of ball receiving leather 2 parallel to the lengthwise direction of index finger stall forming portion 221 is smaller than the length L1 of back leather 1 parallel to the lengthwise direction of index finger stall forming portion 221 only by 5% or less. More specifically, length L2 described above is at least 95% of and smaller than 100% of length L1.

Length L2 may be equal to length L1. In this case, ball receiving leather 2 and back leather 1 are sewed together or/and adhesively joined and then should be subjected to post-working such as deformation into an arc shape by heat.

Meanwhile, if the ratio of length L2 relative to L1 is less than 95%, it is difficult to join ball receiving leather 2 and back leather 1 and ball receiving leather 2 and back leather 1 are too rounded to catch a ball after they are joined.

As in the foregoing, the above ratio is preferably in the range from 96% to 98%, most preferably 97%.

Furthermore, the respective finger stall portions (finger portions) 29 of ball receiving leather 2 and back leather 1 may be formed to have the same size, and only the to the ball receiving surface corresponding portion 27 of ball receiving leather 2 may be cut to be smaller than the ball receiving surface corresponding portion 27 of back leather 1 in the direction parallel to the lengthwise direction of index finger stall forming piece 221.

Herein, finger stall corresponding portion 29 refers to each finger stall forming piece from inter-finger portion 28 to the tip end of the finger, and ball receiving surface corresponding portion 27 refers to the palm portion excluding finger stall corresponding portion 29.

More specifically, referring to FIG. 5, the lengths L21 and L11 of finger stall corresponding portion 29 are the same, while the length L22 of the ball receiving surface corresponding portion 27 of ball receiving leather 2 is set in the range from 95% to 100% of the length L12 of the ball receiving surface corresponding portion 27 of back leather 1. Thus, length L2 parallel to the lengthwise direction of the index finger stall forming piece 221 of ball receiving leather 2 is set in the range from 95% to 100% (preferably from 96% to 98%, more preferably 97%) of length L1 parallel to the lengthwise direction of the index finger stall forming piece 221 of back leather 1.

Thus, when back leather 1 and ball receiving leather 2 are sewed together or/and adhesively joined such that the ball receiving surface side attains an arc shape, finger stall corresponding portion 29 may be formed into an approximately linear shape, and only ball receiving surface corresponding portion 27 is formed into an arc shape. As a result, a glove having an ideal form for catching a ball can be provided.

Note that in FIGS. 5A and 5B, the relation between the lengths L1 and L2 of the portions through the index finger portions of back leather 1 and ball receiving leather 2 are shown, the above concept may be applied to the relation between the lengths of parts through other finger portions. In such a case, the same effects can be expected. Furthermore, the above relation needs only be established for the lengths of portions passing through at least one finger portion.

Meanwhile, the width of ball receiving leather 2 in the direction in which the finger portions are arranged is set approximately the same as that of back leather 1. More specifically, in connection with FIG. 5, the transverse length (width) W2 in ball receiving leather 2 in the direction perpendicular to the lengthwise direction of index finger stall forming piece 221 is set approximately the same as the transverse length (width) W1 in back leather 1 in the direction perpendicular to the lengthwise direction of index finger stall forming piece 221.

Back leather 1 and ball receiving leather 2 having the above-described structure are sewed together or/and adhesively joined so that the ball receiving surface side has an arc shape to manufacture a glove, and a glove ideal for catching a ball can be provided as a result.

Back leather 1 cut as described above is sewed with upper surface leather 3 for forming a hand inserting portion as shown in FIG. 3B. Upper surface leather 3 is not a single piece of leather, but formed of separate parts for respective fingers sewed together. This is to form a three-dimensional space to let in fingers, and the way of separating into parts is not limited to the manner shown in FIG. 3B.

FIG. 2 is a view of ball receiving leather 2 shown in FIG. 3C seen from the backside.

In ball receiving leather 2 in FIG. 2, after a material is cut (in the state in FIG. 3C), embossing is conducted.

In FIG. 2, embossed portion 4 formed by the embossing is provided in the lengthwise direction of all the finger portions and in the vicinity of palm periphery 26. The shape, number and size of embossed portions 4 are not limited to those according to the embodiment shown in FIG. 2. More specifically, such embossed portion 4 may be provided only at an arbitrary finger portion among the finger portions, or whether or not to provide embossed portion 4 in the vicinity of palm periphery 26 is also arbitrarily determined.

Embossed portion 4 is continuously provided for almost the entire region in the lengthwise direction of finger portions in FIG. 2, but the invention is not limited to this arrangement. More specifically, embossing may be performed only at an approximate center of the finger portions, only at an upper part, or only at a lower part. Two embossed portions 4 may be formed above and below, or three or more divisional embossed portions may be provided.

Embossed portion 4 provided in the vicinity of palm periphery 26 is continuous with thumb portion 21 and not continuous with little finger portion 25 in FIG. 2. The portion is thus discontinuous at little finger portion 25 for the following reason. A good glove is believed to flex and be folded into two so that a received ball will not drop. The discontinued part is provided at the above position so that on the line of flexing there is no embossed portion 4 which could prevent the glove from flexing.

It is understood that this does not prevent embossed portion 4 provided at thumb portion 21 from being discontinuous with embossed portion 4 provided in the vicinity of palm periphery portion 26, or embossed portion 4 provided at little finger portion 25 from being continuous with embossed portion 4 provided in the vicinity of palm periphery portion 26.

FIG. 2 is a view of ball receiving leather 2 from the backside, and embossed portion 4 is represented as a recessed portion. A shock absorber 5 is filled in the recessed side of embossed portion 4.

As shock absorber 5, at least one kind of material selected from sponge, felt, an air bag, silicon bouncing putty, polyurethane elastomer, silicon gel, polynorbornane and the like may be used.

Embossed portion 4 can be readily formed by embossing. The operation of filling shock absorber 5 into the recessed side of embossed portion 4 is very easy.

More specifically, such a notch and a leather portion corresponding to the size of the notch as disclosed by Japanese Patent Laying-Open No. 10-165558 are not necessary for the ball receiving leather when a shock absorber is provided.

After shock absorber 5 is filled, a pad member 6 may be sewed or/and adhesively attached. In FIG. 2, pad member 6 attached to index finger portion 22 is secured to ball receiving leather 2 through a sewed portion 81.

Thus, shock absorber 5 filled within embossed portion 4 can be secured in the recessed portion.

Furthermore, if a hard material is used as pad member 6, the finger portions are less likely to be bent toward the backside by the pressure given by a caught ball. Leather, plastics, a metallic plate or the like may be used as the hard material.

Note that pad member 6 may be provided not only at index finger portion 22 but also at each finger portion. The finger portion to provide with the pad member may be arbitrarily selected.

Ball receiving leather 2 having embossed portion 4 filled with shock absorber 5 is sewed together with or/and adhesively joined with back leather 1, and a web portion 7 is provided between thumb portion 21 and index finger portion 22 to form a glove.

If pad member 6 is sewed or/and adhesively joined after shock absorber 5 is filled, shock absorber 5 is fixed and does not move, sewing or/and adhesive joining with back leather 1 will be easier.

Back leather 1 and ball receiving leather 2 are sewed together or adhesively joined as they are set to provide an arc shape on the side of the ball receiving surface. Both sewing and adhesive joining may be employed.

As described above, when ball receiving leather 2 is cut to be smaller than back leather 1, the side of ball receiving surface of the glove naturally takes an arc shape at the time of sewing together or/and adhesively joining them, which makes it easy to set the glove into a desired shape. After this operation, each finger portion gradually rises upwardly on the side of the ball receiving surface, so that the ball receiving surface portion will take a shape including a curved surface as if a small recess is formed in the vicinity of the center of the ball receiving surface portion.

FIG. 1 is a view of the glove manufactured in the above manner seen from the side of ball receiving leather 2.

Embossed portion 4 filled with shock absorber 5 looks raised viewed from the side of ball receiving leather 2. When a ball is caught, the ball first hits the raised portion of embossed portion 4 filled with shock absorber 5. Thus, the impact of the ball is absorbed by the portion and it is weakened upon the fingers inserted in the glove. As a result, the fingers are less hurt by the repetition of ball catching movement using the glove during exercise for hours. In addition, the impact of the ball itself at the time of catching is weakened, the percentage of dropping the ball is reduced.

FIG. 4 is a cross sectional view of the finger portions shown in FIG. 1. The upper side of the figure represents the side of ball receiving leather 2, and the lower side represents the side of back leather 1.

Shock absorber 5 is filled in embossed ball receiving leather 2. Shock absorber 5 is covered with pad member 6 and then secured by pad member 6 sewed to ball receiving leather 2 through sewed portion 81.

Upper surface leather 3 is sewed to back leather 1 sewed (or may be adhesively attached as well) to ball receiving leather 2 through a sewed portion 82. These upper surface leather 3 and back leather 1 form a space to insert fingers.

Pad member 6 is provided at any of index finger portion 22, middle finger portion 23, and third finger portion 24 in the glove shown in FIG. 1.

The use of a hard material for pad member 6 allows the finger portions to be less bent toward the backside by the pressure imposed by a caught ball, and the impact of a ball hit thereupon may be transmitted throughout pad member 6 in a scattered manner, so that the impact upon the fingers can be even further reduced.

When back leather 1 and ball receiving leather 2 are sewed together or/and adhesively joined to form the glove as shown in FIG. 1, a padding of felt or the like may be inserted, or wax for shock absorption may be applied between them, or they may be impregnated with oil similarly to the conventional cases.

An arbitrary shape other than the shape shown in FIG. 1 may be employed for the shape of web portion 7.

Leather lace 72 is used to couple thumb portion 21, web portion 7 and index finger portion 22, and index finger portion 22, middle finger portion 23, third finger portion 24 and little finger portion 25 similarly to the conventional cases.

Pad leather 73 is attached to the edge from thumb portion 21 via the vicinity of palm periphery portion 26 to little finger portion 25. Thus, the edge portion of the joined part of back leather 1 and ball receiving leather 2 is hidden, so that the appearance of the glove is not spoiled.

Furthermore, although not shown, when pad leather 73 is provided also at the upper end of index finger portion 22, middle finger portion 23 and third finger portion 24, small stones or sand will not fill within the tip end of each finger portion if the tip end of each finger portion touches the ground at the time of catching a ball, which improves the durability of the glove.

The recessed portion extending from thumb portion 21 to little finger portion 25 via the vicinity of palm periphery 26 and formed by embossed portion 4 filled with shock absorber 5 directs a ball toward the center of the glove, and also serves to alleviate the impact of the ball.

Furthermore, the raised portion catches the ball and functions to prevent the ball from being dropped from the glove.

Industrial Applicability

The present invention may be effectively applied to gloves for baseball or softball.

What is claimed is:

1. A glove for baseball or softball, comprising:

a back leather (1) having a first finger portion (29), a ball receiving leather (2) attached to said back leather (1) and having a second finger portion (29), and an upper surface leather (3) sewed to said back leather (1) to form a hand inserting portion, wherein the length (L2) of said ball receiving leather (2) in the direction in which said second finger portion extends is in the range from 95% to 98% of the length(L1) of said back leather (1) in the direction in which said first finger portion extends.

2. The glove for baseball or softball according to claim 1, wherein said first and second finger portions include an index finger portion, the lengths of said ball receiving leather and said back leather are both a length in the direction in which said index finger portion extends.

3. The glove for baseball or softball according to claim 1, wherein the length of said ball receiving leather is in the range from 96% to 98% of the length of said back leather.

4. The glove for baseball or softball according to claim 1, wherein the length of said ball receiving leather is 97% of the length of said back leather.

5. The glove for baseball or softball according to claim 1, wherein said back leather and ball receiving leather each have a palm portion, the length of said first finger portion is the same as the length of said second finger portion, the length of said palm portion at said ball receiving leather in the direction in which said second finger portion extends is smaller than the length of the palm portion at said back leather in the direction in which said first finger portion extends.

6. The glove for baseball or softball according to claim 1, wherein said first and second finger portions each include five finger portions, the width of said back leather in the direction in which said first finger portions are arranged and the width of said ball receiving leather in the direction in which said second finger portions are arranged are approximately the same.

7. The glove for baseball or softball according to claim 1, wherein the surface of said ball receiving leather (2) is provided with a raised portion (4) and a recessed part located on the backside of said raised portion (4), said recessed part being filled with a shock absorber (5).

8. The glove for baseball or softball according to claim 7, wherein said raised portion is formed by embossing.

9. The glove for baseball or softball according to claim 7, wherein a pad member is provided between said shock absorber and back leather.

10. The glove for baseball or softball according to claim 7, wherein said ball receiving leather (2) has a palm portion (27), and said raised portion is provided at least one position of said second finger portion (29) and said palm portion (26).

11. The glove for baseball or softball according to claim 7, wherein said shock absorber includes at least one kind of material selected from a group consisting of sponge, felt, an air bag, silicon bouncing putty, polyurethane elastomer, silicon gel, and polynorbornane.

* * * * *